US005765394A

United States Patent [19]

Rhoades

[11] Patent Number: 5,765,394

[45] Date of Patent: Jun. 16, 1998

[54] SYSTEM AND METHOD FOR COOLING WHICH EMPLOYS CHARGED CARBON DIOXIDE SNOW

[75] Inventor: George D. Rhoades, La Grange, Ill.

[73] Assignee: Praxair Technology, Inc., Danbury, Conn.

[21] Appl. No.: 891,761

[22] Filed: Jul. 14, 1997

[51] Int. Cl.[6] ..... F25J 1/00

[52] U.S. Cl. ..... 62/603; 62/63; 62/264; 62/384

[58] Field of Search ..... 62/603, 264, 374, 62/380, 384, 63

[56] References Cited

U.S. PATENT DOCUMENTS 3,443,389 5/1969 Townsend et al. ..... 62/603
3,492,829 2/1970 Stanford, Jr. ..... 62/603
3,786,644 1/1974 Rich et al. ..... 62/10

*Primary Examiner*—Ronald C. Capossela
*Attorney, Agent, or Firm*—Bharat C. Gandhi

[57] ABSTRACT

A method and system acts to cool matter through the use of a carbon dioxide snow/vapor flow. The matter is supported in juxtaposition to an outlet for the carbon dioxide snow/vapor and a conductor which exhibits a reference potential state. To perform the method, a flow of liquid carbon dioxide is subjected to a pressure expansion to create a flow of carbon dioxide snow and vapor. The carbon dioxide snow and vapor then come into contact with a conductive surface and achieves a charge as a result of frictional engagement with the conductive surface. Thereafter, the carbon dioxide snow/vapor is directed towards the matter to be cooled and the conductor which exhibits a reference potential. The reference potential state attracts the carbon dioxide snow and aids in contact thereof on the matter being cooled.

18 Claims, 3 Drawing Sheets

SYSTEM AND METHOD FOR COOLING WHICH EMPLOYS CHARGED CARBON DIOXIDE SNOW

REFERENCE TO RELATED PATENT APPLICATION

The invention described herein is related to the invention described in co-pending U.S. patent application, Ser. No. 08/891,760 entitled "Apparatus for Producing Fine Snow Particles from a Flow of Liquid Carbon Dioxide" to G. Rhoades, and assigned to the same Assignee as this Application.

FIELD OF THE INVENTION

This invention relates to the cooling of matter through use of carbon dioxide snow and, more particularly, to an improved method and system for cooling which uses charged carbon dioxide snow particles.

BACKGROUND OF THE INVENTION

Methods for improving liquid carbon dioxide application are being researched on a world-wide basis. Liquid carbon dioxide is utilized for cooling of various substances, including food and other matter. A conventional food cooler (freezer) uses direct impingement to achieve a cooling of the matter being treated, combined with vapor recirculation to enhance the heat transfer process.

Heat transfer is typically improved by use of fans in a mechanical freezer to create vapor velocity and turbulence. Freezers cooled by carbon dioxide have an added benefit of solid dry ice particles, as well as cold vapor. Around every item to be cooled there is a thin film of vapor at the item's present surface temperature. That film offers considerable resistance to the transfer of refrigeration. The dry ice particles, directed to strike the item to be cooled, pass through the vapor film and contact the item with their approximately −110° F. temperature. In addition, the −110° F. carbon dioxide vapor formed in a pressure expansion is also directed toward the item to be cooled. The dry ice snow/cold vapor combination produces an intense heat transfer area.

In most cases, however, the item to be cooled is moving, such as on a conveyor, and passes quickly through the area of heat transfer. As a result, the amount of cooling is limited by the speed of movement of the matter being treated. Another factor limiting the amount of potential cooling is the location of the item on the conveyor. Thus, the item may pass by, rather than through, the area of most intense heat transfer. Also, dry ice particles that strike the item to be cooled usually bounce off upon impact, so only instantaneous contact is achieved.

High velocity fans are employed in an attempt to recirculate the carbon dioxide snow particulate and cold vapor back onto the item to be cooled. However, some fine snow will become entrained in the exhaust stream with under-utilized cold vapor and be lost from the freezer. This detracts from the utilization of the carbon dioxide snow.

It is known that, under certain conditions, the carbon dioxide snow can attain a static charge because snow particles are dielectric in nature and tend to maintain a charge, once acquired. In U.S. Pat. No. 3,786,644, the existence of such a charge on carbon dioxide snow is viewed as a problem as the snow tends to adhere to inner walls of a horn which is used to disperse the snow. Accordingly, the '644 patent suggests that a high temperature coil be placed in the discharge region, with the coil being heated, to emit light which is indicated as being able to remove the charge.

U.S. Pat. No. 5,287,801 to Clark is directed to a method for coating foodstuffs with flavoring particles. The flavoring particles receive a static charge which insures their adhesion to the foodstuff. The static charge is imparted by electric means.

Accordingly, it is an object of this invention to provide an improved method and apparatus for the cooling of matter which employs carbon dioxide snow and vapor.

It is another object of this invention to provide an improved carbon dioxide snow/vapor cooling method and apparatus that employs electrostatics to provide better adhesion of the carbon dioxide snow to the matter being cooled.

SUMMARY OF THE INVENTION

A method and apparatus acts to cool matter through the use of a carbon dioxide snow/vapor flow. The matter is supported in juxtaposition to an outlet for the carbon dioxide snow/vapor and a conductor which exhibits a reference potential state. To perform the method, a flow of liquid carbon dioxide is subjected to a pressure expansion to create a flow of carbon dioxide snow and vapor. The carbon dioxide snow and vapor then comes into contact with a conductive surface and achieves a charge as a result of frictional engagement therewith. Thereafter, the carbon dioxide snow/vapor is directed towards the matter to be cooled and the conductor which exhibits a reference potential. The reference potential state attracts the carbon dioxide snow and aids in impaction thereof on the matter being cooled.

DETAILED DESCRIPTION OF THE PREFERRED EMBODIMENTS

Figure 1:
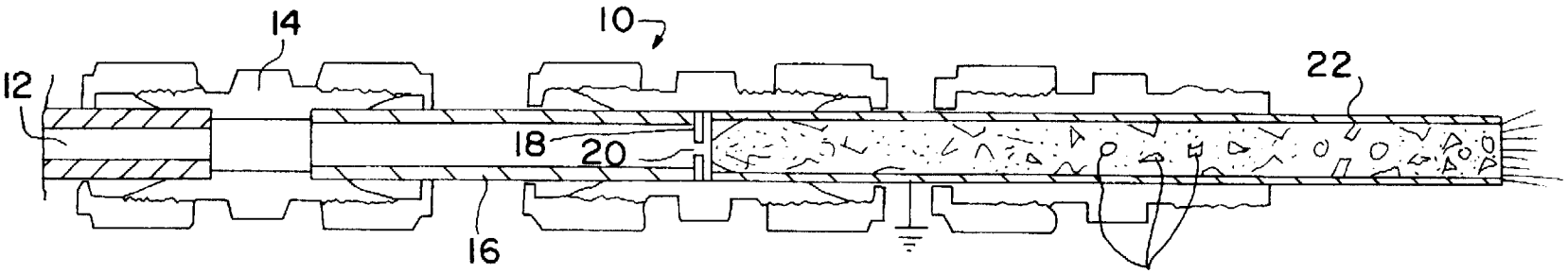
FIG. 1 is a sectional view of a first embodiment of the invention which produces a first expansion of a liquid carbon dioxide flow and further causes a static charge to be created on snow particulate created during the pressure expansion.

Briefly stated, the invention creates a flow of carbon dioxide snow particulate and vapor, with the snow particulate exhibiting an electrostatic charge (generally negative). The carbon dioxide snow is then ejected towards a region of lesser or opposite charge. Matter being cooled is positioned adjacent the region of lesser or opposite charge and the point of ejection of the carbon dioxide snow/vapor. The carbon dioxide snow penetrates the vapor film barrier around the matter being cooled and contacts the surface thereof.

The carbon dioxide snow, being a good insulator, does not immediately discharge its charge, but maintains contact with the matter being cooled for an extended time as it evaporates.

As the charged snow particles are attracted to the item to be cooled, they not only impact on the side that is opposite the point of ejection of the carbon dioxide snow/vapor, but they also are seen to change direction to impact and cling to all sides of the item being cooled. The good electrical dielectric quality of the dry ice snow is a factor in the heat transfer rate. As indicated above, the charge on the snow particulate is not immediately conducted off and onto the matter being cooled. Instead, the carbon dioxide snow particles continue to attach so long as there is an electrostatic difference between the particle charge and the charge on the matter being cooled. As a result, a vapor film barrier is prevented from immediately re-developing.

In a prior art high velocity/turbulent impingement method, some dry ice snow entirely misses the item being cooled, while other of the dry ice snow impacts the item being cooled and then bounces off. In both cases, some of the carbon dioxide snow accumulates at points other than on the item being cooled or becomes entrained in the vented vapor and is lost. The invention largely prevents these effects. The invention further enables savings to come about as a result of reduced energy requirements of the heat transfer devices.

The electrostatic charging process is a relatively low velocity process and enables a minimization of the momentum of the snow particles. Elimination of high velocity liquid carbon dioxide injectors and fans provides a substantial equipment cost savings. Also, construction materials around the electrostatic process are required to be non-conductive. Replacing presently used conductive materials with less expensive non-conducting materials provides additional equipment savings.

The process of electrostatically charging the carbon dioxide snow involves the impacting of the snow particulate onto a conductive surface (i.e., an electron donor) and the transfer of electrons from the conductive surface to the snow particulate. The carbon dioxide snow must be quickly separated from the electron donor material before the electrons imparted to the snow particulate return back to the electron donor material. In general, the more intense the contact and the greater the amount of friction, the greater is the level of electrostatic charge transfer. To assure a sufficient supply of electrons, the electron donor material may be either connected to a negative potential source or may be grounded. When the donor material is grounded, electron transfer is successfully achieved and loss of the charge is avoided due to the velocity that is imparted to the particles by the expansion action just prior to the charging action.

Many material combinations will create an electrostatic charge on carbon dioxide snow. Generally, an electrical conductor is preferred, with copper, silver and gold being the best electrical conductors. Since the dry ice snow is a very good insulator, the snow particulate tend to hold the electrostatic charge well. Copper and silver have been tested and found to produce about the same amount of electrostatic charge on the snow particulate.

It was found that when a flat or curved conductive plate was used to impart the charge, that formation of frost from atmospheric moisture soon decreased the amount of charge transferred to the snow. As a result, it is preferred that the snow particulate pass through a closed region, such as a copper tube, which both acts as an electron donor and minimizes the effect of moisture from the air. More specifically, the fluid flow rate of the carbon dioxide snow/vapor through the tube structure prevents the ingress of ambient air and moisture.

Referring to FIG. 1, an exemplary carbon dioxide snow production apparatus 10 is shown and comprises a liquid carbon dioxide supply tube 12 which is coupled by a coupling 14 to a liquid carbon dioxide expansion tube 16. At the terminating end of expansion tube 16 is a plate 18 which includes a small orifice 20 that leads into a conductive (preferably copper) tube 22.

Copper tube 22 acts as an electron donor for the carbon dioxide snow particulate 24 passing therethrough.

As liquid carbon dioxide is fed through supply tube 12, it enters at a pressure of approximately 300 psig and 0° F. As the liquid carbon dioxide passes through orifice 20, it experiences a substantial expansion that causes its temperature to fall to approximately 110° F., thereby passing through the triple point and enabling generation of snow particulate 24 and vapor. Snow particulate 24 then passes through copper tube 22 and attains a charge as a result of its frictional engagement with the inner surfaces thereof. As a result, the snow particulate emerging from copper tube 22 exhibits a substantial negative charge.

Figure 2:
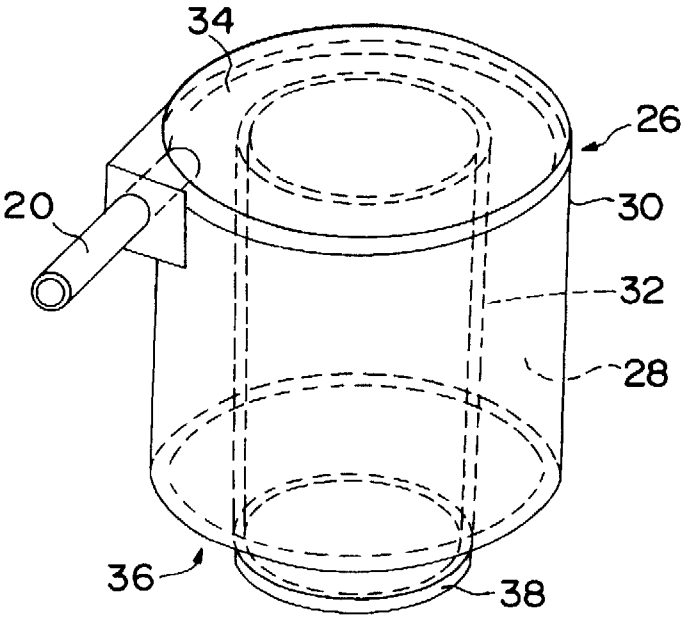
FIG. 2 is a schematic, perspective view of a deceleration tube structure which receives a charged snow/vapor stream and causes a velocity deceleration thereof.

Turning to FIG. 2, copper tube 20 is coupled to a deceleration tube structure 26 which is utilized to reduce the velocity and momentum of the charged snow particles. A lower particle momentum allows the charged snow a better chance to curve towards an item to be cooled as it approaches the item. Thus, copper tube 20 causes a tangential injection of the snow/vapor into an annulus 28 that is present between an outer tube 30 and an inner tube 32. The uppermost openings of tubes 30 and 32 are closed by a top cover 34.

Annulus 28 opens downwardly via orifice 36 and enables the snow, which has progressed helically down annulus 28, to exit and to be directed towards the items being cooled.

The presence of inner tube 32 enables a more effective helical flow of the snow, a drop in its velocity and further prevents the ingress of air and moisture into the center of the annulus. It is to be noted that the bottom of inner tube 32 is sealed by cover 38.

The entirety of deceleration tube structure 26 is preferably constructed from a non-conductive material such as a polycarbonate, polyethtylene or other non-conducting plastic material.

Figure 3:
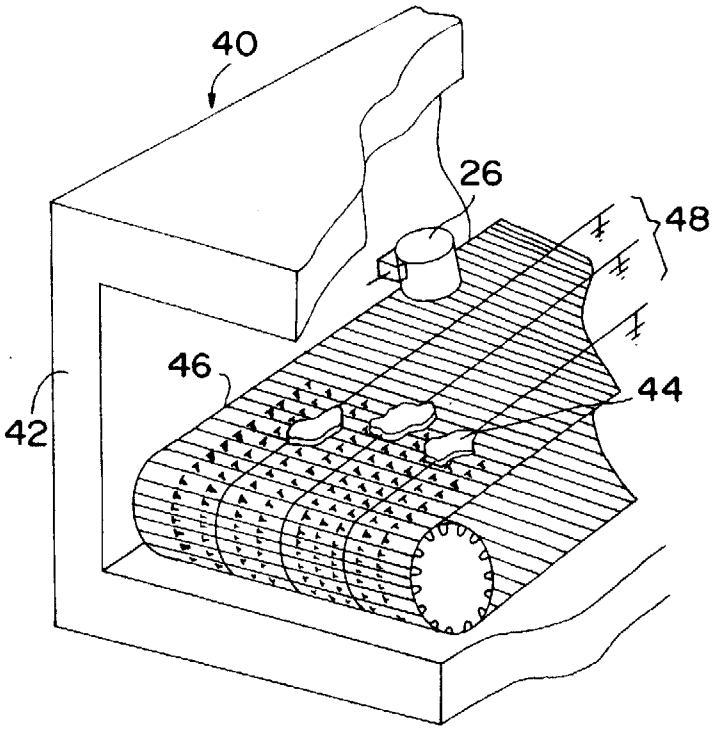
FIG. 3 is a schematic, perspective view of a freezer including a conveyor and incorporating the invention.

Referring to FIG. 3, deceleration tube structure 26 is shown in place in a tunnel freezer 40 which includes a non-conducting liner 42, e.g. such as polyethylene or the like. Product 44 that is being cooled rests on a non-conductive conveyer belt 46. Product 44 can be placed on standoffs to enable the snow to reach the underside of product 44. Conveyer belt 46 may also be ridged so as to avoid the need for the standoff, with the ridges enabling access of the snow to the underside of product 44.

A plurality of conductive straps 48 are either grounded or are connected to a positive potential and underlie conveyer belt 46 and provide a positive electro-static potential which tends to attract the negatively charged snow particulate exiting from deceleration tube structure 26. It is to be understood that further conductors may be embedded in conveyer belt 44 to enable a more even distribution of the electrostatic charge therein. In any event, the conductors are insulated by the non-conductive conveyer belt material so as to avoid any direct contact thereof with the impacting charged snow particles.

Figure 4:
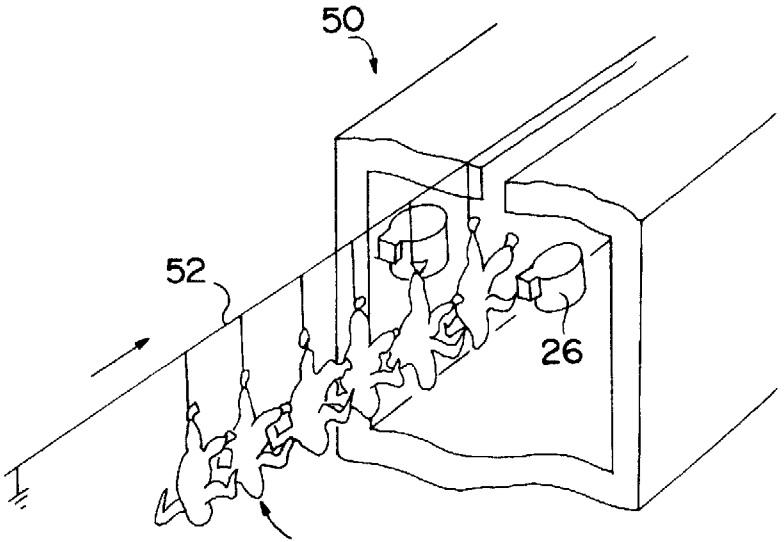
FIG. 4 is a schematic, perspective view of a freezer wherein the conveyor enables the passage of hanging items through the freezer, while enabling use of the invention.

Turning to FIG. 4, a tunnel freezer 50 is illustrated wherein shackled items, such as chickens, hang from a shackle line conveyer 52. If shackle line conveyer 52 is grounded (or connected to a source of positive potential), the shackled items tend to attain the same charge level and will tend to attract snow particulate that is ejected from deceleration tube structures 26.

While the description of the apparatus for producing the electrostatically charged carbon dioxide snow particles indicates that charge is transferred thereto strictly by frictional engagement from a grounded electron donor material, a less preferred embodiment will employ a source of negative potential connected to conductive tube 22 (FIG. 1). However, because the cooling apparatus is often employed to cool food product, it must be cleaned often and the presence of power supplies and conductive wiring make the cleaning effort more tedious.

Figures 5, 6:
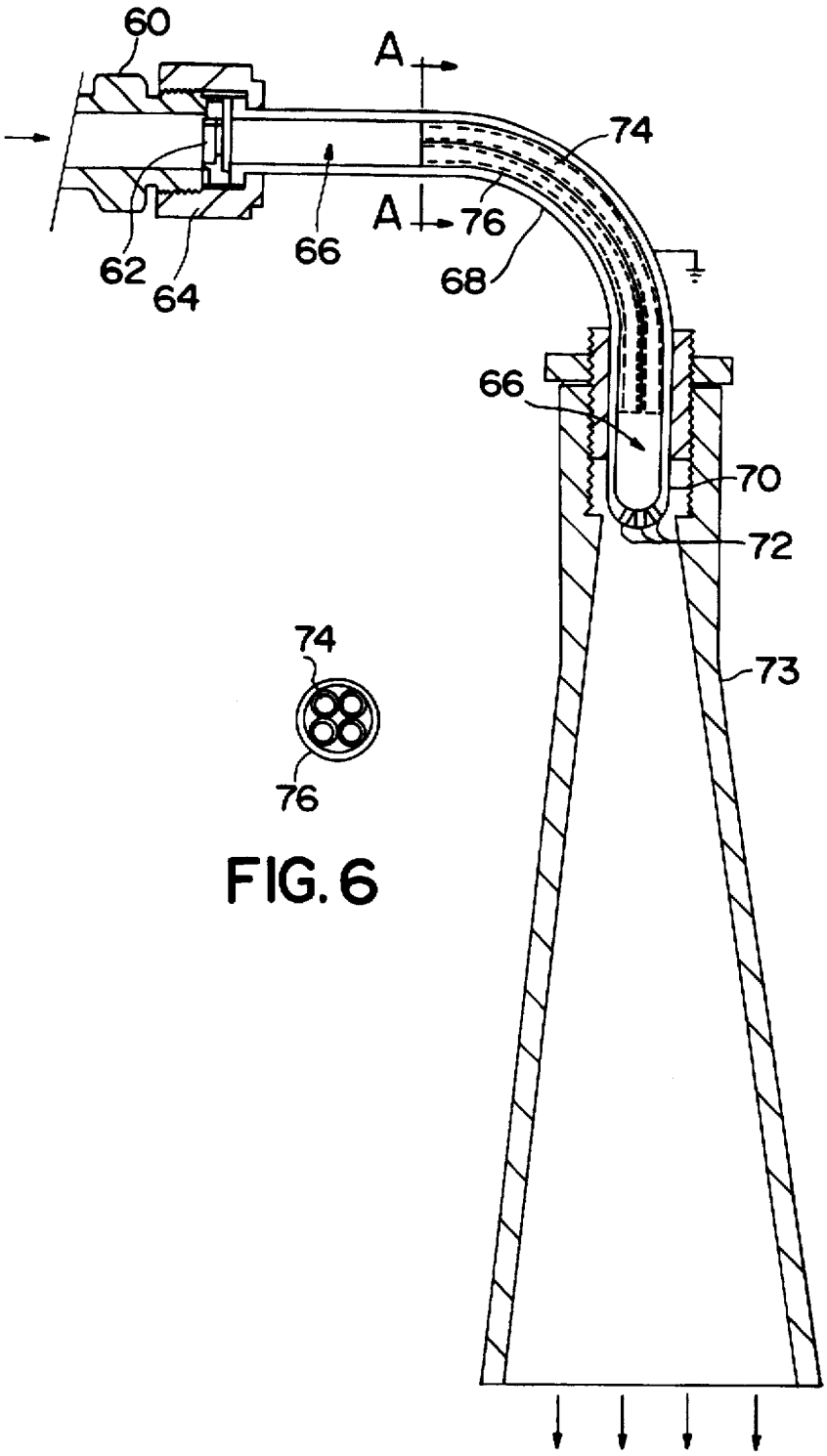
FIG. 5 is a sectional view of a second embodiment of the invention which produces a first expansion of a liquid carbon dioxide flow, through a porous member, into an intermediate pressure region and further causes a static charge to be imparted to snow particulate created during the first pressure expansion.
FIG. 6 is a sectional view of the second embodiment taken along line A—A in FIG. 5.

Referring to FIG. 5, a second embodiment of the invention is illustrated wherein the carbon dioxide expansion occurs while passing through a porous insert, thereby enabling creation of very fine snow particles. More specifically, and as described in the above referenced co-pending Application (the teachings of which are incorporated herein by reference), it is well known that carbon dioxide exhibits a "triple point" at a pressure of approximately 60 lbs. psig, at −70° Fahrenheit. Liquid carbon dioxide is often stored at about 300 psig and about 0° Fahrenheit. When such liquid carbon dioxide is fed at such pressure and temperature to a nozzle incorporating a porous insert, it is preferred that the porous insert have a thickness and pore diameter which, given inlet and outlet pressures, enables the carbon dioxide liquid passing therethrough to reach the triple point at or near the outlet face of the porous insert.

As indicated above, the liquid carbon dioxide reaches the porous insert at about 0° Fahrenheit (from a storage container). It enters the pores of the porous insert and commences expansion (due to the pressure differential thereacross), which expansion causes a cooling of the fluid. When the temperature reaches approximately −70° Fahrenheit and the pressure reaches about 60 psig, the triple point is reached where a solid dry ice component appears in the liquid flow. This state creates the condition which enables the generation of a fine snow particulate. The liquid carbon dioxide flowing in the fine channels, comprising many small streams of liquid and vapor, create the fine snow at or near the outlet face of the porous insert.

Turning now to FIG. 5, nozzle inlet 60 receives a liquid carbon dioxide flow and applies the flow to one side of an expansion disk 62 (preferably porous stainless steel) which is held in place by a retaining ring 64. The liquid carbon dioxide enters disk 62 and experiences expansion within the pores thereof. Accordingly, snow is created within or at the outlet face of disk 62 and a combination of snow and vapor exits therefrom as a result of the pressure differential thereacross. Upon exiting, the snow/vapor enters a region 66 of intermediate pressure within conductive conduit 68.

To achieve a downward flow of the snow/vapor, conduit 68 includes a 90° bend. Terminal end 70 of conduit 68 includes one or more divergently oriented secondary expansion orifices 72, from which the charged snow particles exit to atmospheric pressure. Terminal end 70 of conduit 68 is positioned within a snow horn 73 which protects the fine snow from the heat of the surrounding atmosphere.

Within conduit 68 are a plurality of metallic guide channels 74, 76, etc which tend to evenly distribute the snow particulate within conduit 68. Without the guide channels, centrifugal forces would cause the snow to migrate outward when passing through the 90° bend, leaving the vapor on the inner portion thereof. Such action would result in an uneven distribution of the snow particles at orifices 72. A sectional view is shown in FIG. 6 of the channels, taken along line A—A in FIG. 5. Charging of the snow particles occurs during transit through conduit 68 and guide channels 74, 76, etc.

The reason for the bend in conduit 68 is that the liquid carbon dioxide is preferably piped (i.e., via inlet 60) so that it flows only upwardly and/or horizontally towards porous disk 62. Thus, any solid carbon dioxide that may accumulate adjacent to the upstream side of porous disk 62 is melted by carbon dioxide vapor which gravitates upward in the piping. This feature is taught in U.S. Pat. No. 5,020,330 to Rhoades et al., assigned to the same assignee as this Application.

It should be understood that the foregoing description is only illustrative of the invention. Various alternatives and modifications can be devised by those skilled in the art without departing from the invention. For instance, while a porous disk has been described as a preferred expansion member, any expansion member with many fine channels (e.g., porous or drilled) may be used. Accordingly, the present invention is intended to embrace all such alternatives, modifications and variances which fall within the scope of the appended claims.

I claim:

1. A method for cooling matter, said method employing carbon dioxide snow and vapor, said matter supported in juxtaposition to a source of carbon dioxide snow/vapor and conductive means which manifests a reference potential state, said method comprising the steps of:

subjecting a liquid carbon dioxide flow to a pressure expansion to create a flow of carbon dioxide snow particles;

causing said carbon dioxide snow particles to physically engage a conductor surface and achieve an electrostatic charge; and directing said electrostatically charged snow particles towards said matter and said conductive means, said reference potential state on said conductive means attracting said electrostatically charged carbon dioxide snow particles and aiding contact thereof on said matter.

2. The method as recited in claim 1, wherein said conductor surface comprises an inner surface of a conductive conduit.

3. The method as recited in claim 2, wherein said conductive conduit is electrically grounded.

4. The method as recited in claim 1, wherein said matter is supported on conveyor means which includes said conductive means, said conveyor means moving said matter past a flow of said electrostatically charged carbon dioxide snow particles.

5. The method as recited in claim 1, wherein said conductive means comprises electrical conductors manifesting a potential that is more positive than a charge which is resident on said carbon dioxide snow particles.

6. An apparatus for cooling matter, said apparatus employing carbon dioxide snow and vapor and comprising:

a conduit for providing a flow of liquid carbon dioxide;

aperture means coupled to said conduit for subjecting said liquid carbon dioxide to a pressure expansion to create a flow of carbon dioxide snow particles;

a conductive conduit for receiving said flow of carbon dioxide snow particles and imparting thereto a charge as a result of physical engagement between said carbon dioxide snow particles with a surface of said conductive conduit;

conductive means for manifesting a reference potential state that is attractive to said carbon dioxide snow particles that have been charged; and means for supporting said matter in juxtaposition to said conductive means so as to enable attraction of said charged carbon dioxide snow particles to said matter.

7. The apparatus as recited in claim 6, further comprising:

deceleration means comprised of a nonconducting material, for receiving said charged carbon dioxide snow particles from said conduit, reducing a speed of travel thereof and directing said charged carbon dioxide snow particles towards said matter and said conductive means.

8. The apparatus as recited in claim 7, wherein said deceleration means comprises:

a first cylinder;

a second cylinder having a lesser diameter than said first cylinder and positioned within said first cylinder to create a flow annulus therebetween; and means for coupling one end of said flow annulus to said conductive conduit so as to enable said charged carbon dioxide snow particles to travel in a generally helical path to an outlet of said flow annulus, said outlet positioned to direct said charged carbon dioxide snow particles towards said matter.

9. The apparatus as recited in claim 8, further comprising:

means for sealing an end of said second cylinder that is juxtapositioned to said outlet of said flow annulus.

10. The apparatus as recited in claim 6, wherein said conductive conduit is electrically grounded.

11. The apparatus as recited in claim 6, wherein said means for supporting is a conveyor which includes said conductive means, said conveyor moving said matter past a flow of said carbon dioxide snow particles.

12. The apparatus as recited in claim 6, wherein said conductive means comprise electrical conductors manifesting a potential that is more positive than a charge which is resident on said charged carbon dioxide snow particles.

13. An apparatus for cooling matter, said apparatus employing carbon dioxide snow and vapor and comprising:

an inlet for providing a flow of high pressure liquid carbon dioxide;

a conductive conduit defining a region of intermediate pressure;

an expansion member having many fine channels, coupled between said inlet and said conductive conduit, for enabling said liquid carbon dioxide to experience a pressure expansion in said fine channels so as to create a flow of carbon dioxide snow particles within said conductive conduit, flow of said carbon dioxide snow particles in said conductive conduit causing a charge to be imparted thereto as a result of physical engagement between said carbon dioxide snow particles with a surface of said conductive conduit; and at least one orifice at a terminal end of said conduit for enabling a second expansion of said flow of snow particles from said region of intermediate pressure to a region of atmospheric pressure.

14. The apparatus as recited in claim 13, further comprising:

conductive means for manifesting a reference potential state that is attractive to said charged carbon dioxide snow particles; and means for supporting said matter in juxtaposition to said conductive means so as to enable attraction of said charged carbon dioxide snow particles to said matter.

15. The apparatus as recited in claim 13, further comprising:

a snow horn coupled to said terminal end of said conductive conduit for receiving said charged carbon dioxide snow particles from said conductive conduit and directing said charged carbon dioxide snow particles towards matter to be cooled.

16. The apparatus as recited in claim 13, further comprising:

channel means positioned within said conductive conduit for preventing said snow particles from congregating into a single region within said conductive conduit.

17. The apparatus as recited in claim 13, wherein a plurality of divergent orifices are positioned at the terminal end of said conductive conduit.

18. The apparatus as recited in claim 13, wherein said conductive conduit is electrically grounded.

* * * * *